US005125125A

United States Patent [19]

Barsacq

[11] Patent Number: 5,125,125

[45] Date of Patent: Jun. 30, 1992

[54] CENTRAL SUCTION CLEANING INSTALLATION WITH WATER FLUSHING AND DOUBLE RINSING

[76] Inventor: Gabriel Barsacq, 3 rue Louison Bobet, 64200 Biarritz, France

[21] Appl. No.: 651,337

[22] PCT Filed: Jun. 12, 1990

[86] PCT No.: PCT/FR90/00414

§ 371 Date: Feb. 13, 1991

§ 102(e) Date: Feb. 13, 1991

[87] PCT Pub. No.: WO90/15566

PCT Pub. Date: Dec. 27, 1990

[30] Foreign Application Priority Data

Jun. 13, 1989 [FR] France ..... 89 07992

[51] Int. Cl.[5] ..... B01D 47/02

[52] U.S. Cl. ..... 15/314; 15/353; 55/218; 55/227; 55/242; 55/255; 55/256; 55/271; 55/431; 55/472; 55/DIG. 8

[58] Field of Search ..... 15/301, 314, 353; 55/218, 227, 242, 255, 256, 271, 431, 472, DIG. 8

[56] References Cited

U.S. PATENT DOCUMENTS

| | | | |
|---|---|---|---|
| 2,673,619 | 3/1954 | Martin | 15/353 X |
| 3,173,164 | 3/1965 | Congdon | 15/319 X |
| 3,318,075 | 5/1967 | Wilson | 55/242 X |
| 4,312,646 | 1/1982 | Fattinger et al. | 55/218 |
| 4,375,976 | 3/1983 | Potter | 55/242 X |
| 4,553,991 | 11/1985 | Barsacq | 15/353 X |
| 4,721,516 | 1/1988 | Barsacq | 15/319 X |

FOREIGN PATENT DOCUMENTS

| | | |
|---|---|---|
| 878078 | 9/1942 | France . |
| 2097910 | 2/1972 | France . |
| 1326297 | 6/1970 | United Kingdom . |

*Primary Examiner*—Chris K. Moore
*Attorney, Agent, or Firm*—Oliff & Berridge

[57] ABSTRACT

This invention relates to a central suction-cleaning installation with water flushing and double rinsing. This installation is characterized in that it contains water flush generating means consisting of a water intake at the bottom end (5) of the chamber (7) via a duct (25) linked to a source of pressurized water (20) and in which there are interposed an electrovalve (26) and a needle valve tap (27) controlled by a float (28) which is arranged inside the chamber, above a reserve of water (13), in that the chamber is further provided with a double rinsing system containing, on the one hand, a diffuser ring (31) directed at said reserve of water and, on the other, a spray diffuser (32) of a dust filter (35) placed between the suction plant (34) and said diffuser ring (31), whereby the ring and spray diffusers are linked to said source of pressurized water via a duct (29) which is provided with an electrovalve (30). This invention is useful for applications in central suction-cleaning.

7 Claims, 4 Drawing Sheets

CENTRAL SUCTION CLEANING INSTALLATION WITH WATER FLUSHING AND DOUBLE RINSING

TECHNICAL FIELD

The present invention relates to a central vacuum cleaning system with a complete, automatic water-flush double-rinse cleaning-evacuation system.

BACKGROUND

French Patent FR-A-2,593,081 teaches a central vacuum system composed of a housing comprising at its upper part a compartment accommodating a vacuum system and in its lower part a supply of water, called wash water, whose level touches the opening of a drain line in which a flexible shutoff sleeve valve is mounted controlled by a pressurized water source, and a dip tube immersed in said water supply and connected outside the housing and by a network of fixed pipes to intake openings located in the areas or rooms of a building for residential or other use, the central part of said housing also comprising means for generating the flushing action.

These means are composed of an annular perforated duct located in the central part of the housing, said duct pointing toward the water supply and connected to a pressurized water line that also controls said flexible shutoff sleeve valve.

SUMMARY OF INVENTION

The goal of the present invention is to improve a system of this kind by improving the water flushing action and adding to it a final rinsing device to improve the efficiency of the vacuuming and the cleaning of the inside of the housing.

To this end, the goal of the invention is to provide a central vacuum cleaning system consisting of a housing comprising in the upper part a compartment wherein a vacuum system is accommodated and in the lower part both a supply of water called wash water whose level touches the opening of a drain line wherein a flexible shutoff sleeve valve is located, controlled by a source of pressurized water, and a dip tube immersed in said supply of water and connected outside the housing and through a network of fixed pipes to intake openings located in the areas or rooms of a building for residential or other use. The central part of said housing also comprises means for generating the flushing action characterized by the flush generating means being composed of a water inlet at the lower end of the housing, connected by a pipe to said source of pressurized water and wherein a solenoid valve is located, as well as a stopcock and a needle valve controlled by a float located inside the housing, above the water supply. The house is also provided with a double rinsing system comprising firstly an annular diffuser directed towards said water supply and secondly of a diffuser for sprinkling a dust filter located between said compartment of the vacuum system and said annular diffuser, with the annular and sprinkler diffusers being connected to said source of pressurized water through a pipe provided with a solenoid valve, and by the timed control circuits connected to said solenoid valves being designed to trigger the following cycle: closing of the flexible sleeve valve, filling of the housing at the end of an adjustable preset time, draining of the housing accompanied by rinsing of the lower part of the housing and the dust filter.

BRIEF DESCRIPTION OF THE DRAWINGS

Other characteristics and advantages will emerge from the following description of embodiments of devices according to the invention, with the description being provided solely as an example and with reference to the attached drawings wherein.

DETAILED DESCRIPTION OF PREFERRED EMBODIMENTS

Figure 1:
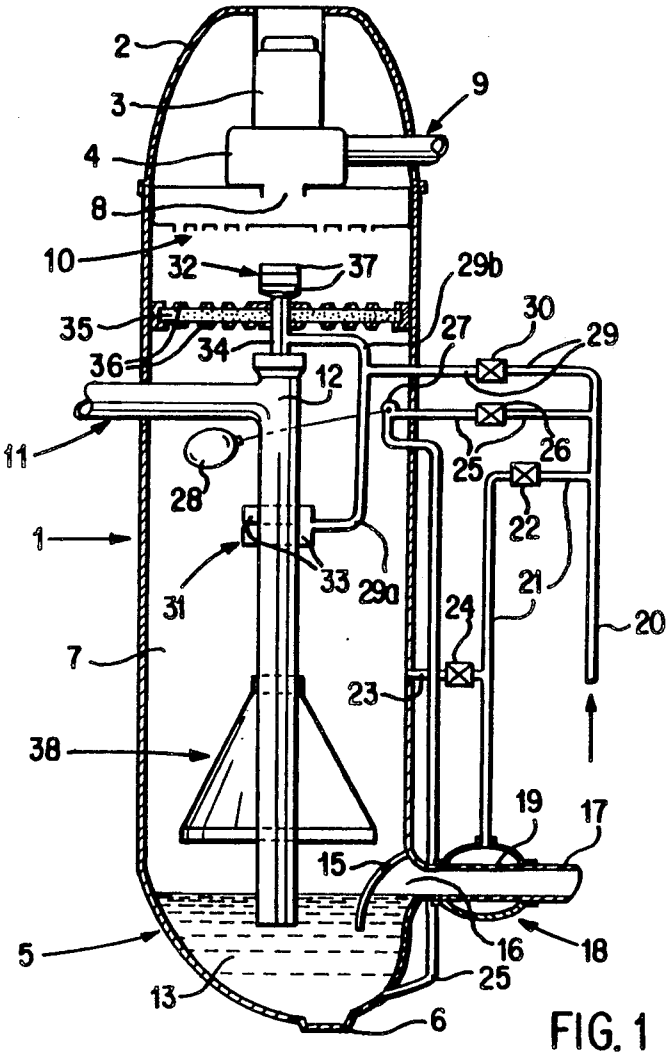
FIG. 1 is a vertical section through a device according to the invention in the resting state.

The device shown schematically in FIG. 1 comprises an essentially cylindrical dust-removing unit and comprises a hollow central body 1 surmounted by a housing 2 enclosing the assembly composed of motor 3 and turbine 4 and integral at its lower part with a bowl 5 with a hemispherical end blocked by a drain plug 6.

Body 1 is comprised of a closed housing 7 communicating at its upper part with the intake opening 8 of turbine 4, exhausted through a pipe 9.

Opening 8 is protected by a perforated plate 10.

Dust enters body 1 through a pipe 11 equipped with a dip tube 12 immersed in a water supply 13 provided in bowl 5.

Pipe 11 is connected in known fashion to a system (not shown) of pipes terminating at a given number of intake openings distributed in various areas or rooms and each provided with a microswitch (14, FIG. 6) connected to the electrical circuits controlling the installation.

A baffle 15 is mounted at right angles to opening 16 for draining the device, said opening communicating with a pipe 17 for draining dirty water and containing a valve 18 of the flexible shutoff sleeve type 19.

The water that controls valve 18 is the pressurized water, supplied for example from the municipal water supply and fed through a pipe 20.

Pipe 20 is connected to valve 18 by a pipe 21 containing a solenoid valve 22 called the drain valve.

Between solenoid valve 22 and valve 18 is a pipe 23 connected to the inside of housing 7 and containing a solenoid 24 called the discharge valve.

Pipe 20 is also connected by a pipe 25 to the lower end of bowl 5. Pipe 25 contains both a solenoid valve 26 called the fill valve and, inside housing 7, a needle valve 27 controlled by a float 28.

Pipe 20, finally, is connected by a pipe 29 containing a solenoid valve 30, called the rinse valve, firstly to an annular diffuser 31 by a line **29*a* and secondly to a sprinkler diffuser 32 by a line 29*b***.

Annular diffuser 31 is mounted around the vertical part of dip tube 12 and is located essentially in the central part of housing 7. In the embodiment shown, diffuser 31 is composed of two removable parts defining between them at least one circular row of holes 33 pointing downward.

Diffuser 32 is mounted at the end of a vertical pipe 34 located above tube 12 in the direction of vacuum system 3, 4. This pipe 34 is connected to pipe **29*b* and passes through a dust filter 35 in the shape of a disk sandwiched between two perforated shells 36. In the embodiment shown, diffuser 32 comprises at least one and preferably two superimposed circular rows of holes 37 pointing downward, in other words toward filter 35**.

Finally dip tube 12 is provided at its lower part above water supply 13 with a deflecting plate 38 in the shape of a funnel pointing downward against the jets of water.

Figure 6:
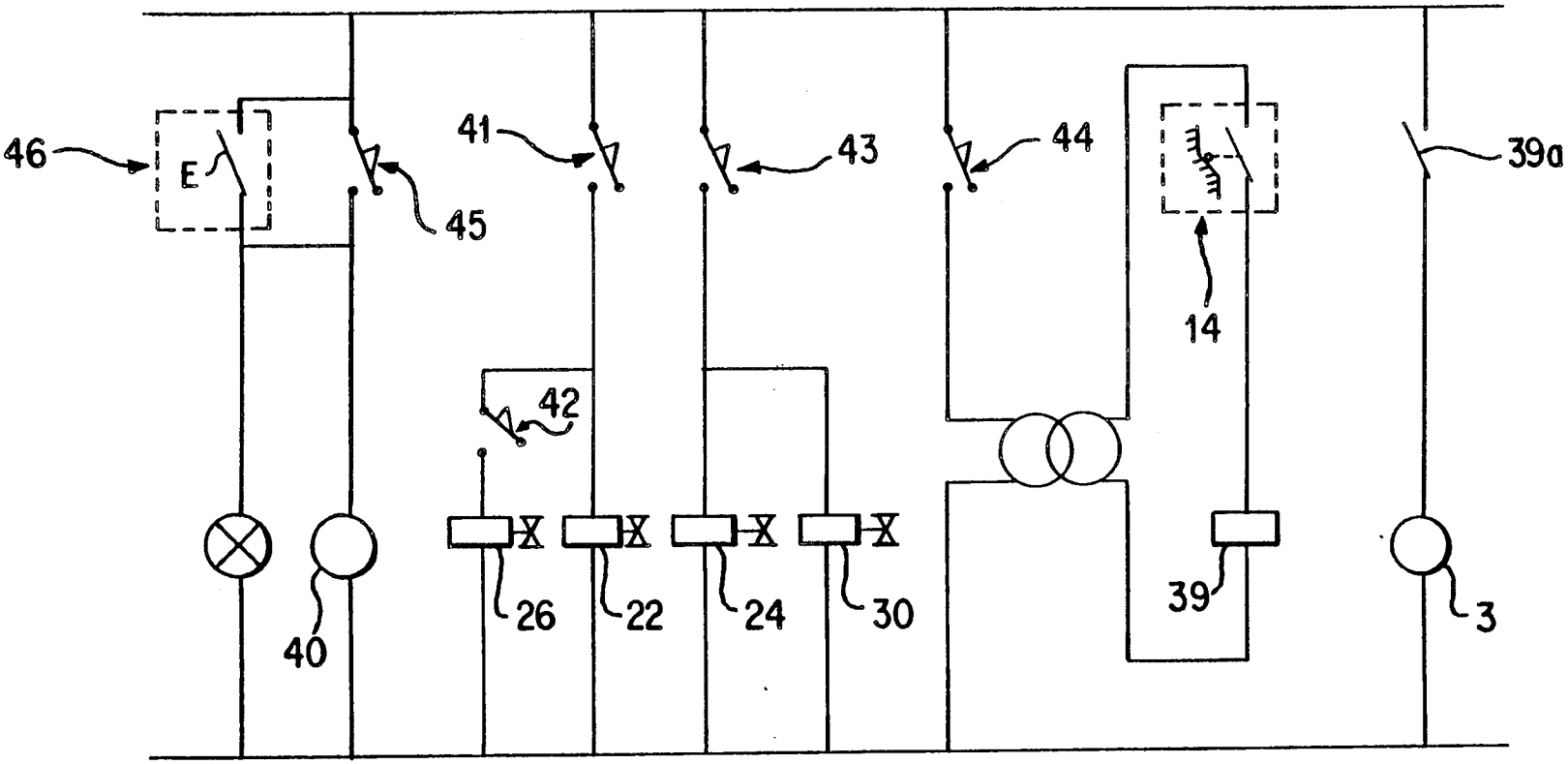
FIG. 6 shows the electrical schematic of the device.

In the electrical schematic shown in FIG. 6, 39 represents a locking relay with its switch 39*a* wired into the circuit powering motor 3 of vacuum system 3-4.

The circuit comprises a programmer with a motor 40 and various switches controlled in succession, namely switches 41 and 42 for solenoid valves 22 and 26, switch 43 for solenoids 24 and 30, switch 44 for cutting the power to switches 14 and motor 3 and switch 45 for shutting off programmer motor 40.

Programmer motor is started by a pushbutton 46.

The system works as follows, with reference to the diagram in FIG. 6 as well as FIGS. 2 to 5.

The programmer (40) is started by pressing pushbutton 46 that initiates a cycle that lasts six hours for example, during which switches 41 to 45 will be closed according to a preset program.

Figure 2:
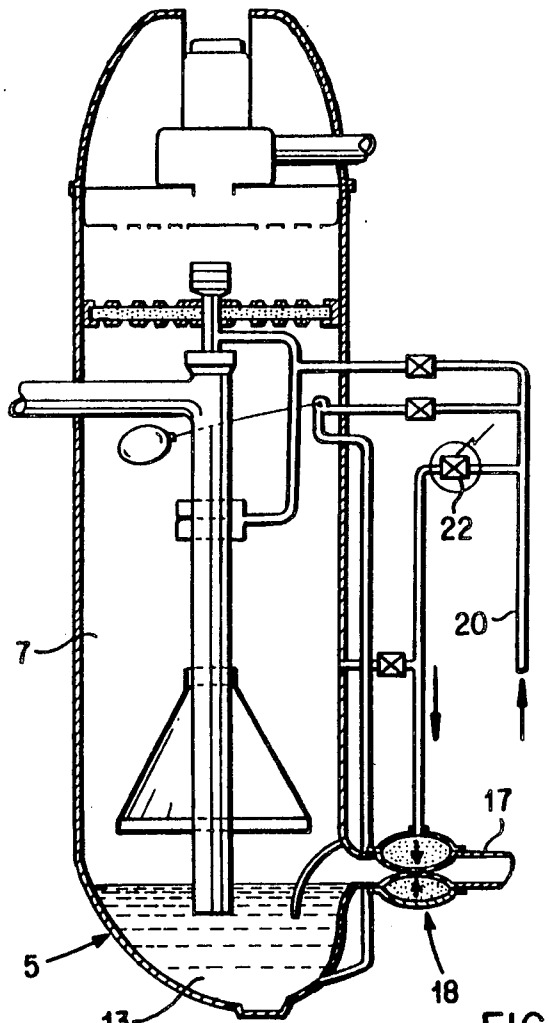
Figure 5:
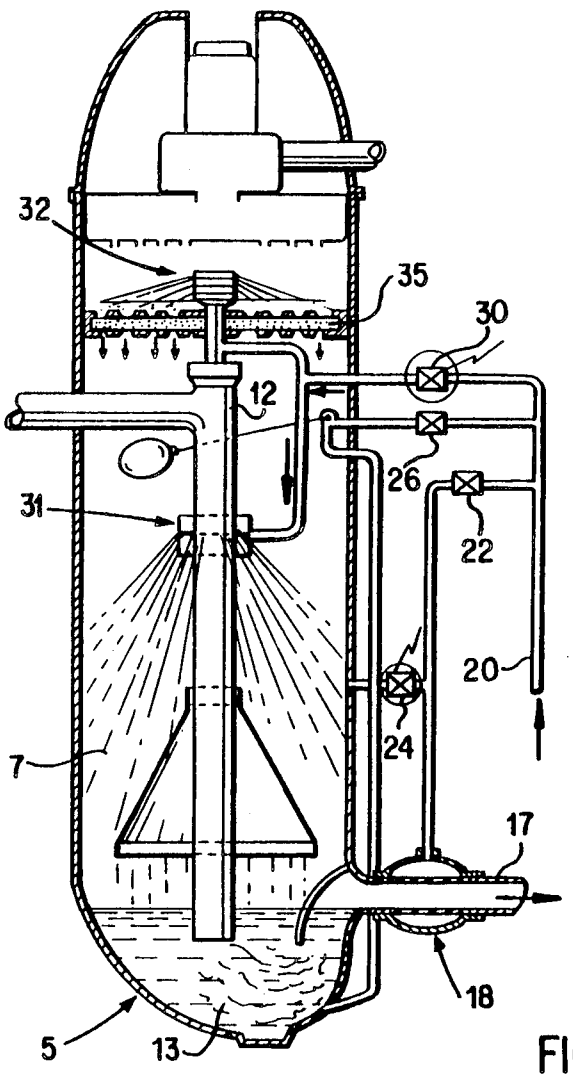

The cycle controlled by the programmer starts with closure of switch 41, opening solenoid 22 to close valve 18 (FIG. 2). A few seconds later switch 44 is closed, thus starting motor 3.

The latter operates independently of the programmer when the vacuum system (not shown) is plugged into one of the intake openings (not shown) mentioned above. Switch 14 closes, causing motor 3 to start.

Figure 3:
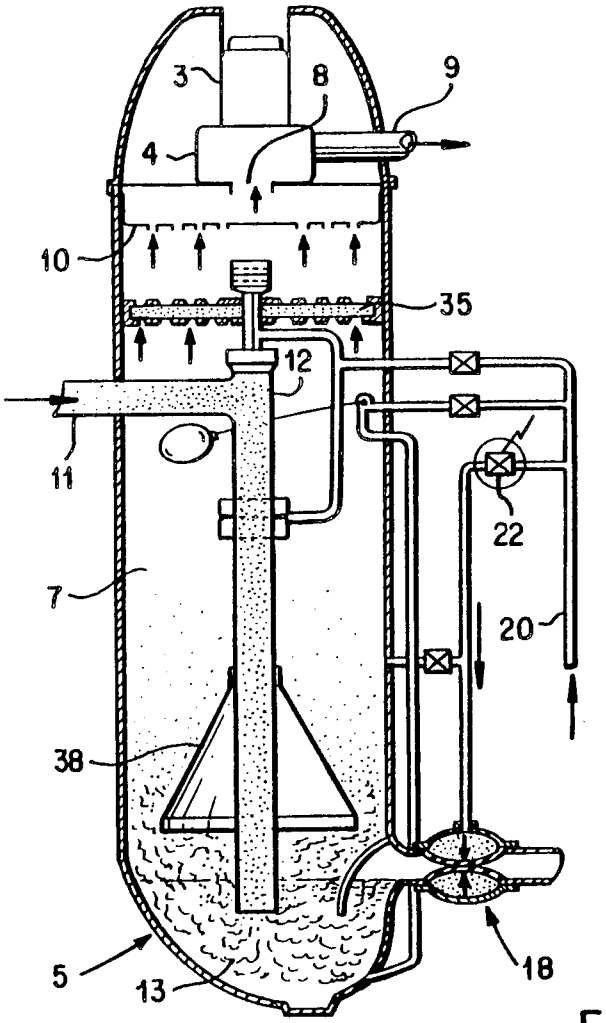
FIGS. 2 to 5 show various phases of the operation of the device.

FIG. 3 shows the operation of the device. The dust-laden air passes through pipe 11 and tube 12, immersed in water supply 13 where coarser debris and dust are trapped.

The residual particles if any pass through and are trapped in filter 35 and the air, practically free of any solid particles, passes through opening 8 and is discharged through pipe 9.

Toward the end of the program cycle, switch 44 is opened, preventing motor 3 from being turned on or turning it off if it is running. As soon as switch 44 opens, the flushing action is performed, draining and then rinsing housing 7, with all of this being done during a time interval of four minutes for example.

Figure 4:
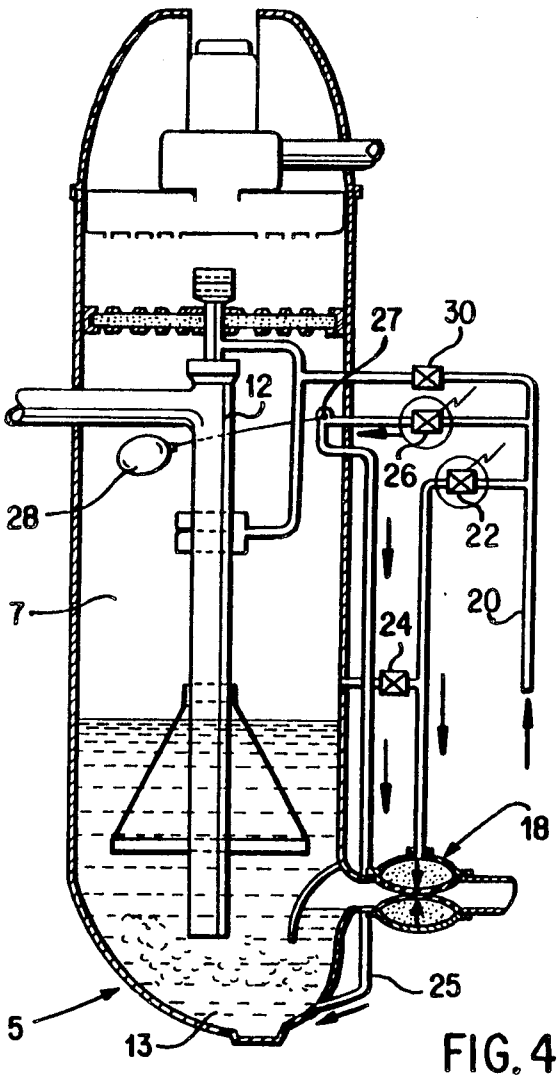

FIG. 4 shows the operation of the flushing action triggered by the closure of switch 42 that opens solenoid valve 26. The water fills housing 7 from the bottom up to the level of float 28 which sets the maximum level (safety) and stops the entrance of water by closing valve 27.

Then switch 43 is closed and opens solenoid valves 24 and 30 while switches 41 and 42 open at the same time, closing solenoid valves 22 and 26. When solenoid valve 24 opens, valve 18 can open (FIG. 5) and the water in housing 7 is drained through pipe 17 while diffuser 31 rinses the lower part and diffuser 32 sprays filter 35 to rid it of its dust.

Before the above four minutes have elapsed causing switch 44 to return to the closed position, switch 43 is opened.

The end of the cycle is determined by the opening of switch 45, cutting off the power to programmer motor 40. Switches 41 to 45 are then all open as shown in FIG. 6 and solenoid valves 22, 24, 26, and 30 are all de-energized as shown in FIG. 1, so that the device is at rest, with valve 18 open.

The device is then ready for a new cycle triggered by pressing button 46 again.

Figure 7:
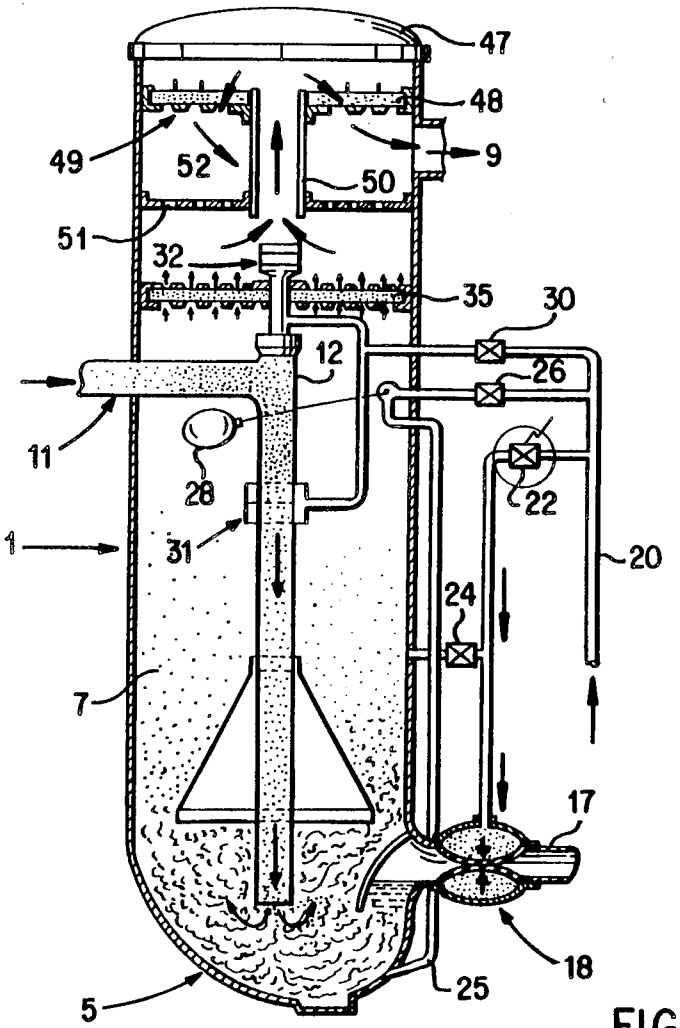
FIG. 7 is a vertical section through an industrial version of the device in FIG. 1.

FIG. 7 shows a version called the industrial version of the device shown in FIG. 3, wherein vacuum system (3, 4) because of its dimensions, cannot be fitted into the body of the dust-removing device and is not shown in FIG. 7. Body I of the device is extended at the top so as to delimit, above filter 35 and diffuser 32, a cylindrical recess closed by a lid 47 and accommodating an auxiliary dust filter 48 of annular shape supported by a perforated plate 49 pierced at its center by a hole accommodating a tube 50 held at its lower part by an annular plate 51 and terminating above and near diffuser 32.

An annular space 52 is thus defined between the two plates 49 and 51 and tube 50, said space communicating with drain pipe 9.

The air drawn in, after passing through first filter 35, enters tube 50, travels above second filter 48, goes through it and then passes into chamber 52, finally being vented through pipe 9 connected to the vacuum system.

The operation of this version is otherwise identical in all respects to that of the device shown in FIGS. 1 to 5.

Finally, the invention is obviously not limited to the embodiments shown and described above but on the contrary includes all variations, especially as regards shape, dimensions, and mountings for filters 35, 48 and diffusers 31 and 32.

What is claimed is:

1. A central vacuum cleaning system, comprising:

a housing body which comprises:

an upper part connected to a vacuum system;

a lower part comprising a water supply and a dip tube, wherein the level of water in said water supply may extend to an opening of a drain line with a flexible shutoff sleeve valve controlled by a source of pressurized water, and wherein said dip tube is immersed in said water supply and is connected by at least one pipe to intake openings in rooms requiring cleaning; and a central part comprising means for generating a flushing action, wherein said means comprises a water inlet at the lower part of said housing connected by a pipe to said source of pressurized water, and a first solenoid valve and a needle valve controlled by a float mounted inside said housing above water in said water supply;

wherein said housing is provided with a double rinsing system comprising an annular diffuser directed toward said water supply and a sprinkler diffuser directed toward a dust filter between said vacuum system and said annular diffuser, wherein said annular diffuser and sprinkler diffuser are connected to said source of pressurized water by a pipe with a second solenoid valve, and wherein said first and second solenoid valves are controlled by timed control circuits which operate a cycle comprising closure of said flexible sleeve valve, filling said housing so that said filling starts at an adjustable preset time, and draining said housing while rinsing said lower part of said housing and said dust filter.

2. A system according to claim 1, wherein said upper part comprises a compartment containing a vacuum system.

3. A system according to claim 1, wherein said upper part is connected to a vacuum system located outside the housing, and wherein said upper part comprises a first auxiliary dust filter through which air drawn from outside said housing is forced to pass and a second auxiliary dust filter into which said air is forced to pass after traversing said first auxiliary dust filter, and wherein said upper part is connected by a drain pipe to said vacuum system located outside said housing.

4. A system according to claim 1, wherein said annular diffuser is mounted on a vertical part of said dip tube and comprises at least one circular row of holes directed toward said water supply.

5. A system according to claim 1, wherein said sprinkler diffuser is located above a filter disk located above said dip tube, wherein said sprinkler diffuser comprises at least one circular row of holes pointing toward said filter disk.

6. A system according to claim 1, wherein a lower part of said dip tube has a funnel-shaped deflector wherein a larger diameter opening of said funnel-shaped deflector is directed toward the bottom of said housing.

7. A system according to claim 1, wherein said timed control circuits connected to said solenoid valves comprise a programmer which activates switches to provide energy to said solenoid valves and to turn said vacuum system on and off.

* * * * *